US009321056B2

(12) United States Patent
Boehm et al.

(10) Patent No.: US 9,321,056 B2
(45) Date of Patent: Apr. 26, 2016

(54) WET-CLEANING ELECTROSTATIC FILTER FOR CLEANING EXHAUST GAS AND A SUITABLE METHOD FOR THE SAME

(75) Inventors: Tobias Boehm, Froendenberg (DE); Hermann Kuhrmann, Reken (DE); Julius Rawe, Datteln (DE)

(73) Assignee: Westfaelische Hochschule Gelsenkirchen, Bocholt, Recklinghausen, Gelsenkirchen (DE)

( * ) Notice: Subject to any disclaimer, the term of this patent is extended or adjusted under 35 U.S.C. 154(b) by 792 days.

(21) Appl. No.: 12/998,688

(22) PCT Filed: Nov. 19, 2009

(86) PCT No.: PCT/DE2009/001661

§ 371 (c)(1),
(2), (4) Date: Jul. 5, 2011

(87) PCT Pub. No.: WO2010/057488

PCT Pub. Date: May 27, 2010

(65) Prior Publication Data

US 2011/0252965 A1 Oct. 20, 2011

(30) Foreign Application Priority Data

Nov. 20, 2008 (EP) ..... 08020223

(51) Int. Cl.
*B03C 3/00* (2006.01)
*B03C 3/78* (2006.01)
*B03C 3/014* (2006.01)
(Continued)

(52) U.S. Cl.
CPC . *B03C 3/78* (2013.01); *B03C 3/014* (2013.01); *B03C 3/12* (2013.01); *B03C 3/16* (2013.01)

(58) Field of Classification Search
None
See application file for complete search history.

(56) References Cited

U.S. PATENT DOCUMENTS 1,905,993 A 4/1933 Buff
2,874,802 A * 2/1959 Gustafsson et al. ..... 95/71
(Continued)

FOREIGN PATENT DOCUMENTS

WO WO 02/085524 10/2002
WO WO 2006/004490 1/2006

OTHER PUBLICATIONS

International Search Report, Jul. 5, 2011.

*Primary Examiner* — Duane Smith
*Assistant Examiner* — Phillip Shao
(74) *Attorney, Agent, or Firm* — Collard & Roe, P.C.

(57) ABSTRACT

The invention relates to an electro-filter (1) for exhaust gas cleaning and/or heat recovery, particularly also for exhaust gas cleaning for the exhaust gases of biomass firings, in which the electro-filter (1) has a precipitation chamber (2) through which the exhaust gas is passed, whereby a charging device (6) for electrostatic charging of particles present in the exhaust gas is disposed in the region of the precipitation chamber (2) or adjacent to the precipitation chamber (2). In such an electro-filter (1), a precipitation device (12) that is electrostatically charged opposite to the charge of the particles, or is grounded, and has a large surface area in relation to its volume, is disposed in the region of the precipitation chamber (2), to interact with the particles, through which device the particles electrostatically charged by the charging device (6) flow, whereby a dispensing device (5) for cleaning fluid sprays the region of the precipitation device (12), at least periodically, and the cleaning fluid cleans away the particles deposited on the surface of the precipitation device (12).

35 Claims, 4 Drawing Sheets

Figure 1:
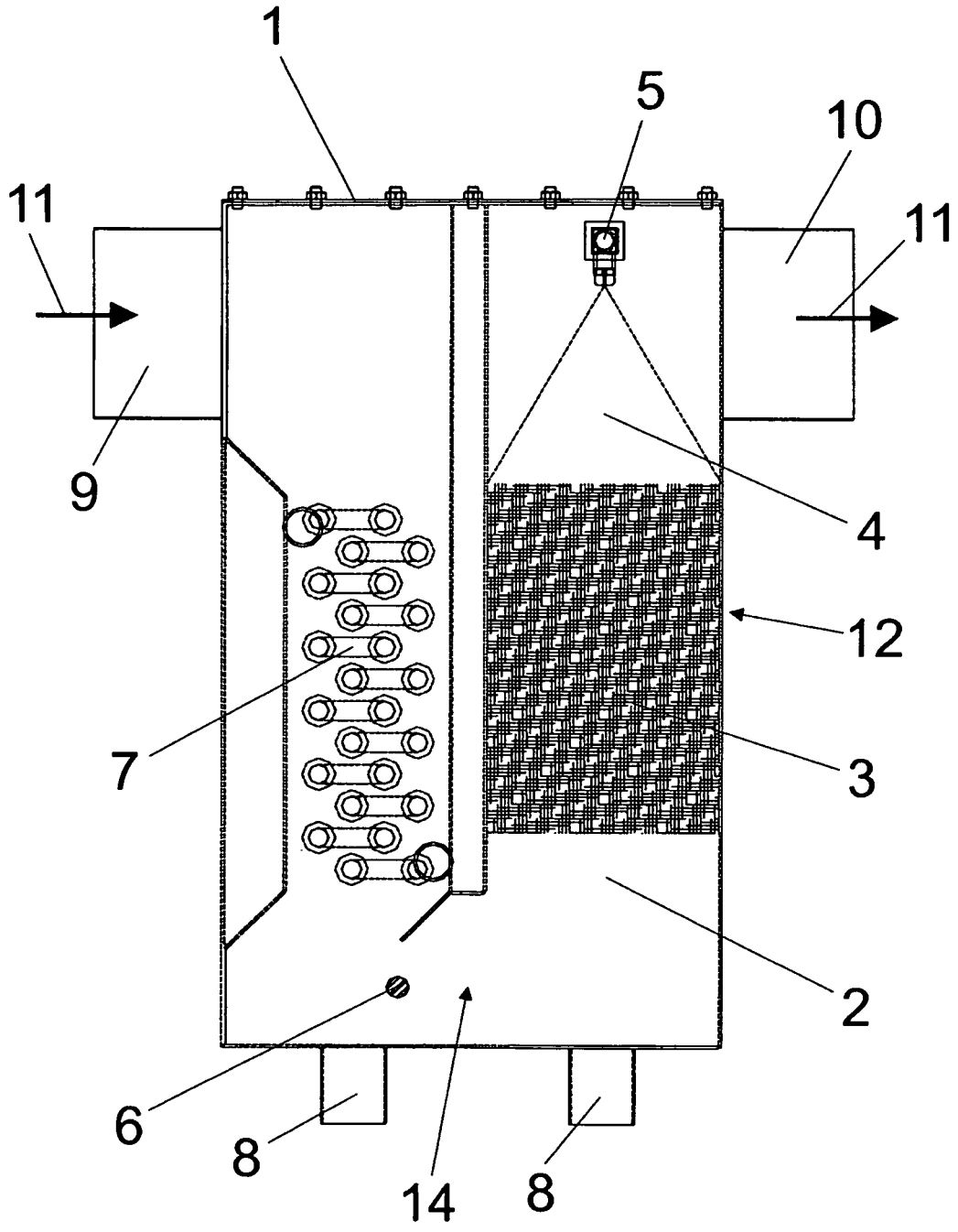

(51) Int. Cl.
*B03C 3/12* (2006.01)
*B03C 3/16* (2006.01)

(56) References Cited

U.S. PATENT DOCUMENTS 3,745,751 A * 7/1973 Zey et al. ..... 422/161
3,807,137 A * 4/1974 Romell ..... 95/72
5,601,791 A * 2/1997 Plaks et al. ..... 422/169
5,855,652 A 1/1999 Talley
6,245,126 B1 * 6/2001 Feldman et al. ..... 95/59
6,533,841 B1 * 3/2003 Jepsen ..... 95/75
6,858,064 B2 * 2/2005 Bologa et al. ..... 95/65
7,632,341 B2 * 12/2009 Triscori et al. ..... 96/44
7,662,219 B2 * 2/2010 Maekawa et al. ..... 96/25
2008/0038173 A1 2/2008 Bradburn et al.
2009/0114092 A1 * 5/2009 Bengtsson et al. ..... 95/75

* cited by examiner

WET-CLEANING ELECTROSTATIC FILTER FOR CLEANING EXHAUST GAS AND A SUITABLE METHOD FOR THE SAME

CROSS REFERENCE TO RELATED APPLICATIONS

This application is the National Stage of PCT/DE2009/001661 filed on Nov. 19, 2009, which claims priority under 35 U.S.C. §119 of European Application No. 08 020 223.7 filed on Nov. 20, 2008, the disclosure of which is incorporated by reference. The international application under PCT article 21(2) was not published in English.

The invention relates to a wet-cleaning electro-filter for exhaust gas cleaning, in accordance with the preamble of claim 1, as well as to a method suitable for this, in accordance with the preamble of claim 21.

The invention relates to an electrostatic, wet-cleaning electro-filter for exhaust gas cleaning and/or heat recovery, in accordance with claim 1, as well as to a method for exhaust gas cleaning and/or heat recovery by means of a wet-cleaning electro-filter for any desired application cases—particularly also for the flue gases of biomass firings. Here, exhaust gas cleaning is understood to mean not only a reduction in particulate emissions but also a reduction in gaseous and odor-type emissions.

The ongoing discussion of fine dust has brought about the result that the legislature intends to issue stricter requirements concerning emissions. In this connection, a reduction in fine dust and ultra-fine dust emissions is particularly being debated.

For a long time, already, so-called scrubbers have been used as wet precipitators for particulate emissions. Their design principle is based on the mass inertia of the dust particles to be removed, in the exhaust gas stream; these particles cannot follow the exhaust gas stream as it flows around the water droplets that are sprayed in, in the spray field; they impact on the droplets and are precipitated with them. This is the reason why wet precipitators can only bring about precipitation of coarser dust particles up to approximately 0.5 μm. Smaller dust particles can no longer be effectively precipitated, because of the low mass inertia of the dust particles, since they follow the gaseous fluid stream and thus are not subject to any interactions with the fluid droplets produced in the scrubber.

However, current publications document that the maximum of the fine dust emissions of wood firings, for example, lies at an average aerodynamic diameter of less than 0.5 μm. Thus, for example, the maximum of the fine dust emissions of wood pellet firings lies below 100 nm, in other words in the ultra-fine dust range. Theoretically, wet precipitators therefore cannot bring about any reduction in ultra-fine dust.

In contrast, dry electrostatic precipitators are able to precipitate even ultra-fine dust particles smaller than 100 nm with up to 99% effectiveness. The precipitation principle is based on a corona point discharge and the resulting particle charging, so that the negatively charged particles can be precipitated on a grounded precipitation electrode. Usual constructions are tube electro-filters or plate electro-filters, for example in power plants. However, such precipitators, which work in dry electrostatic manner, have some disadvantages. These are, for one thing, their construction shape and construction size. They have to be cleaned mechanically, though, and this either results in an interruption in the operation of the precipitator, and with this, possibly of an entire plant, or at the same time, brings about emissions of the swirled-up precipitated dust particles during cleaning. In contrast to wet precipitators, they cannot recover any energy from the flue gases. Likewise, spark discharges from the high-voltage electrode can result in ignition and explosion of the glue gas. Further disadvantages are frequent cleaning intervals, as well as, for smaller systems, the need for partly manual cleaning by the operator or the chimneysweep.

Furthermore, wet electro-filters are also known. Mechanical cleaning is eliminated. Instead, cleaning takes place by means of spraying the precipitation electrode with water. These wet electro-filters also have disadvantages with regard to construction shape and construction size, though, and they have a complicated technical structure, resulting in high costs. Also, condensation of harmful substances contained in the exhaust gas takes place, causing an accumulation of the harmful substances in the circulating water; otherwise, the demand for water becomes great.

In contrast, a wet precipitator developed by the Japanese company Mitsubishi, called MDDS (Mitsubishi Di-Electric Droplet Scrubber) combines electrostatic precipitation with wet scrubbing, whereby the latter makes use of the dipole character of the water, in the method presented. The particle-charged exhaust gas is pre-charged before entry into the actual precipitation chamber, and passed through a scrubber field. Subsequently, it flows through a chamber similar to a plate condenser, whereby one side of the chamber lies at high voltage, the other at mass/ground potential. As a result, a homogeneous electrical field is generated between the plates, thereby causing the water molecules (dipoles) to become aligned. Because of this, electrical fields also form between the water droplets present in the chamber, and for this reason, dust particles and other contaminants present in the exhaust gas stream are accelerated toward the droplets. This method allows precipitation rates of 90-99%. Disadvantages of this method result from the construction shape and construction size, as well as from the fact that it is not possible to retrofit existing scrubbers with this method, without great technical effort.

Furthermore, woven fabric filters are also known. In the case of these filters, the surface (woven fabrics made of metal, textile, cellulose) is so fine-pored that the dust particles are held back. Cleaning takes place mechanically or pneumatically. Woven fabric filters require a lot of space, their cleaning releases dust, and furthermore, there is a very great pressure loss, therefore great additional blower power is needed to carry away the exhaust gases.

Also, precipitation of the dust particles is accomplished by means of cyclones. In the cyclones, the coarser dust is precipitated as the result of the inertia of the dust particles; no ultra-fine dust precipitation takes place, though, and greater blower power is required.

In so-called condensation precipitators that are also known, slight dust precipitation takes place, and this is furthermore dependent on the fuel water content and on the reflux temperatures.

It is therefore the task of the present invention to reduce the dust emissions of exhaust gases of any kind, and, in particular, from solids firings, and, in this connection, to guarantee operation of the corresponding system that is stable in the long term.

The solution of the task according to the invention is evident, with regard to the wet-cleaning electro-filter, from the characterizing features of claim 1, in interaction with the features of the preamble. Further advantageous embodiments of the invention are evident from the dependent claims.

The invention proceeds from an electro-filter of the stated type, for exhaust gas cleaning and/or heat recovery, particularly also for exhaust gas cleaning for the exhaust gases of biomass firings, in which the electro-filter has a precipitation chamber through which the exhaust gas is passed, whereby a charging device for electrostatic charging of particles present in the exhaust gas is disposed in the region of the precipitation chamber or adjacent to the precipitation chamber. Such an electro-filter is developed further in that a precipitation device that is electrostatically charged opposite to the charge of the particles, or is grounded, and has a large surface area in relation to its volume, is disposed in the region of the precipitation chamber, to interact with the particles, through which device the particles electrostatically charged by the charging device flow, whereby a dispensing device for cleaning fluid sprays the region of the precipitation device, at least periodically, and the cleaning fluid cleans away the particles deposited on the surface of the precipitation device. Such a combination of a precipitation device having a large surface area for interaction with the particles, a dispensing device for damp cleaning of the particles from the surface of the precipitation device, as well as electrostatic charging of the particles before they pass through the precipitation device, allows an essentially automatic method of operation of the electro-filter, reliable even over an extended period of time, even at a high degree of cleaning of undesirable particles. In this connection, the electro-filter according to the invention can be used for cleaning any gas streams that carry small particles of any kind with them, which particles could be disadvantageous for further processing of the gas stream or also for discharge of the gas stream into the environment. In simplifying manner, the terms exhaust gas and particles will always be used here when such a gas stream or corresponding particles are meant, whereby exhaust gas does not circumscribe only the exhaust gas of a combustion process or the like. In this connection, the electro-filter charges the particles in the exhaust gas by means of corona discharge. Advantages of the electro-filter according to the invention are, in this connection, a simple structure as well as a compact method of construction, a low electricity requirement as well as a low consumption of cleaning fluid at great cleaning performance. Likewise, a high volume stream can be achieved by means of the low flow resistance, with great ultra-fine dust precipitation, at the same time.

Furthermore, it is advantageous if the precipitation device has a filling composed of electrostatically chargeable components, between which the exhaust gas can pass and give off its particles, which were previously electrostatically charged. Such a filling of components that can be electrostatically charged, particularly having a large surface area in relation to their volume, for interaction with the particles, allows a high degree of precipitation of the ultra-fine dust, since every particle has an opportunity, often enough, to be deposited on the surface, as the result of repeated interaction of every particle with the large surface area, as the particles pass through the filling. A particularly large surface area of the filling can be achieved if the filling is formed from an aggregate of individual components of the filling that have a geometrically non-specific shape. Such an aggregate of individual components having a geometrically non-specific shape generally forms a large surface area in and of itself. Because of the assignment of the individual components to one another, which is also geometrically non-specific, many flow channels form between the individual components, in which channels the exhaust gas is deflected, again and again, and in addition, a corresponding improvement in the interaction of the particles of the exhaust gas with the surface area of the individual components is achieved.

It is particularly advantageous if the individual components of the aggregate border on one another in such a state that an electrostatic charge or grounding applied externally to the precipitation device is distributed over the entire aggregate, and essentially all the individual components of the filling are electrostatically charged or grounded. In this way, the electrical charge or the change can be coupled into the filling in simple manner, by means of the contact of each individual component with further individual components of the filling disposed adjacent to it, in that corresponding contacting takes place from the outside, and the electrical potential spreads over the entire filling, by way of the electrically conductive individual components.

The filling can be structured in particularly advantageous manner in that the filling has metallic chips, particularly turnings or the like, or metallic wools or the like. Metallic chips of this type, such as turnings, shavings, or the like usually have a very irregularly shaped geometry and can be stored in the filling, in compact manner, only by means of keeping corresponding channels and free areas open. At the same time, these metallic chips or metallic wools are electrically conductive, in themselves, so that an electrical potential applied to the filling from the outside necessarily spreads out over the entire filling. Furthermore, such metallic chips or metallic wools are inexpensive to purchase, since they are usually waste products from the production sector or metal workshops or the like, and these materials occur in large amounts there. As a result, the filling according to the invention can be produced very cost-advantageously, and thus the method of operation of the electro-filter is not very cost-intensive.

In another embodiment, it is possible that the filling is formed from a bulk material composed of electrostatically chargeable parts, preferably of electrostatically chargeable plastic bodies or the like. Such electrostatically chargeable parts can have an irregular shape, in terms of their geometry, for example, and therefore come to lie against one another in the filling while keeping corresponding channels open, and at the same time, parts formed from plastic and made electrostatically conductive can be produced in very cost-advantageous manner.

In another embodiment, it is also possible that the filling is formed from metallic and/or electrostatically chargeable plates or bodies having a specific geometric shape. In this connection, such electrostatically chargeable plates or bodies having a specific geometric shape are disposed within the precipitation device in an arrangement that is also geometrically specific, whereby in a further embodiment, the plates or bodies are disposed in the precipitation device in such a manner that they form a plurality of channels for passage of the exhaust gas between them, in which the electrostatically charged particles of the exhaust gas can be deposited on the plates or bodies that have the opposite electrostatic charge. In this way, a large surface area for interaction with the particles of the exhaust gas, and thus a high precipitation rate of the particles from the exhaust gas, can likewise be achieved. Cleaning of such plates or bodies having a specific geometric shape by means of the cleaning fluid is also possible in particularly simple manner, since the cleaning fluid can easily move through the geometric arrangement of the plates or bodies.

It is particularly advantageous if the filling and/or the precipitation device is/are renewable independent of the rest of the electro-filter, for example if the filling and/or the precipitation device can be introduced into the precipitation chamber in the form of a unit that is replaceable in its totality, preferably a cartridge or the like. In this way, the filling can either be renewed in its entirety, or can easily be brought to a cleaning process, without the filling having to be removed from the precipitation device bit by bit and also re-introduced bit by bit. In this way, a replacement or cleaning of the filling can be significantly accelerated.

It is particularly important that the filling fills the entire passage cross-section of the precipitation chamber and that the entire exhaust gas flows through the filling. As a result, it is reliably precluded that the exhaust gas stream flows around the filling without being cleaned of the particles, and the quality of cleaning of the exhaust gas stream as a whole is guaranteed.

Furthermore, it is possible that the charging device is disposed, in the flow direction, ahead of the precipitation chamber or also, in the flow direction, within the precipitation chamber and ahead of the precipitation device. In this way, the particles of the exhaust gas stream are electrically or electrostatically charged at an early point in time, before flowing through the precipitation device, so that the particles can be captured particularly well by the surface area of the precipitation device, which has the opposite charge or is grounded.

It is furthermore advantageous if a number of nozzles is disposed in the precipitation chamber, in such a manner that the cleaning fluid is sprayed onto the precipitation device in the form of spray jets or in the manner of a mist. By means of spraying in the cleaning fluid in the form of spray jets or a spray mist, a particularly good distribution of the cleaning fluid over the entire volume of the precipitation device and therefore of the filling can be achieved, so that every part of the surface area of the filling or of the precipitation device comes into contact with the cleaning fluid and thus the particles of the exhaust gas that have been deposited there can be cleaned off. In this connection, cleaning using the cleaning fluid can take place preferably in fully automated manner, periodically, by means of one or more spray washers. In this connection, in a further embodiment, the cleaning fluid can wet essentially all the individual components of the filling after being sprayed on, preferably under the influence of gravity, and loosen and carry away particles of the exhaust gas that have been deposited there. In this connection, the cleaning fluid that is sprayed onto the precipitation device moves through the channels of the filling, under the influence of gravity, all the way to the lower end of the precipitation device, and exits from the filling there. In this way, the cleaning fluid wets almost the entire surface area of the filling and carries all the deposited particles from the exhaust gas stream along with it. In this way, simple, cost-advantageous, and nevertheless very effective cleaning of the precipitation device or of the filling can be achieved.

Likewise, it is possible that the charging device is disposed within the precipitation chamber behind the nozzles, in the flow direction. In this way, the charging device can be cleaned continuously and at the same time by means of the cleaning fluid dispensed by the nozzles, so that no encrustations can form on the charging device and also the use of a ceramic feed line to the charging device would become possible.

Depending on the type of exhaust gas, it can be advantageous if the materials of the filling for cleaning of aggressive exhaust gases are configured in such a manner that the filling consists of an electrochemically less noble material than the rest of the precipitation device, and therefore acts as a consumable anode. In this way, it is prevented that the precipitation chamber or the sheath of the precipitation device corrodes over time, because of aggressive components of the exhaust gases, or is actually dissolved, since the filling acts as a consumable anode, but this does not have a disadvantageous effect, because the filling is replaced.

It is furthermore possible that a heat exchanger is disposed ahead of and/or behind the entry into the precipitation chamber, in which exchanger the temperature of the exhaust gas is lowered and/or a part of the amount of heat contained in the exhaust gas is recovered. At high exhaust gas temperatures, in particular, the exhaust gas temperature can be lowered by providing a heat exchanger ahead or behind, and thus part of the energy of the exhaust gas can be recovered. Furthermore, in this way the amount of fluid sprayed in can be minimized, and overly great evaporation of the cleaning fluid can be avoided, if placement of the heat exchanger occurs ahead of the entry into the precipitation chamber or the precipitation device.

It is furthermore advantageous that the precipitation device can be structured not only for new facilities, but also so that it can be retrofitted on existing exhaust gas systems.

The invention furthermore relates to a method for exhaust gas cleaning and/or heat recovery, particularly also for exhaust gas cleaning for the exhaust gases of biomass firings, in which an electro-filter has a precipitation chamber through which the exhaust gas is passed, whereby a charging device for electrostatic charging of particles present in the exhaust gas is disposed in the region of the precipitation chamber or adjacent to the precipitation chamber. In this connection, the particles electrostatically charged by the charging device can be passed through a region of the precipitation chamber in which a precipitation device that is electrostatically charged opposite to the charge of the particles, or is grounded, is disposed, whereby the region of the precipitation device is sprayed, at least periodically, by means of sprayed-in cleaning fluid, and the particles deposited on the surface of the precipitation device are cleaned off.

It is particularly advantageous if the cleaning fluid is collected after passing through the precipitation device, or, if there is little contamination and water is used as the cleaning fluid, passed into the waste water network. In another embodiment, it is also possible that the cleaning fluid is collected after passing through the precipitation device, and cleaned, or also re-used, for example. Depending on the degree of contamination, the used cleaning fluid, such as water, for example, can be introduced directly into the sewer system or can be collected and disposed of. This eliminates the periodic cleaning and disposal of dust that is necessary in the case of other dry electro-filters. The cleaning fluid is drained from the electro-filter, together with the particles dissolved in it, and either collected or disposed of, or treated and introduced into the waste water network, or, if contamination is slight, also introduced directly into the waste water network.

It is possible, in a first embodiment, that spraying in the cleaning fluid takes place in the flow direction of the exhaust gas through the filling. Another possible embodiment provides that spraying in the cleaning fluid takes place counter to the flow direction of the exhaust gas through the filling. In this way, an additional counter-current effect can be achieved. Also, it is possible that spraying in the cleaning fluid takes place in a cross-current or also transverse to the flow direction of the exhaust gas through the filling.

A particularly preferred embodiment of the electro-filter according to the invention is shown in the drawing.

Figure 2:
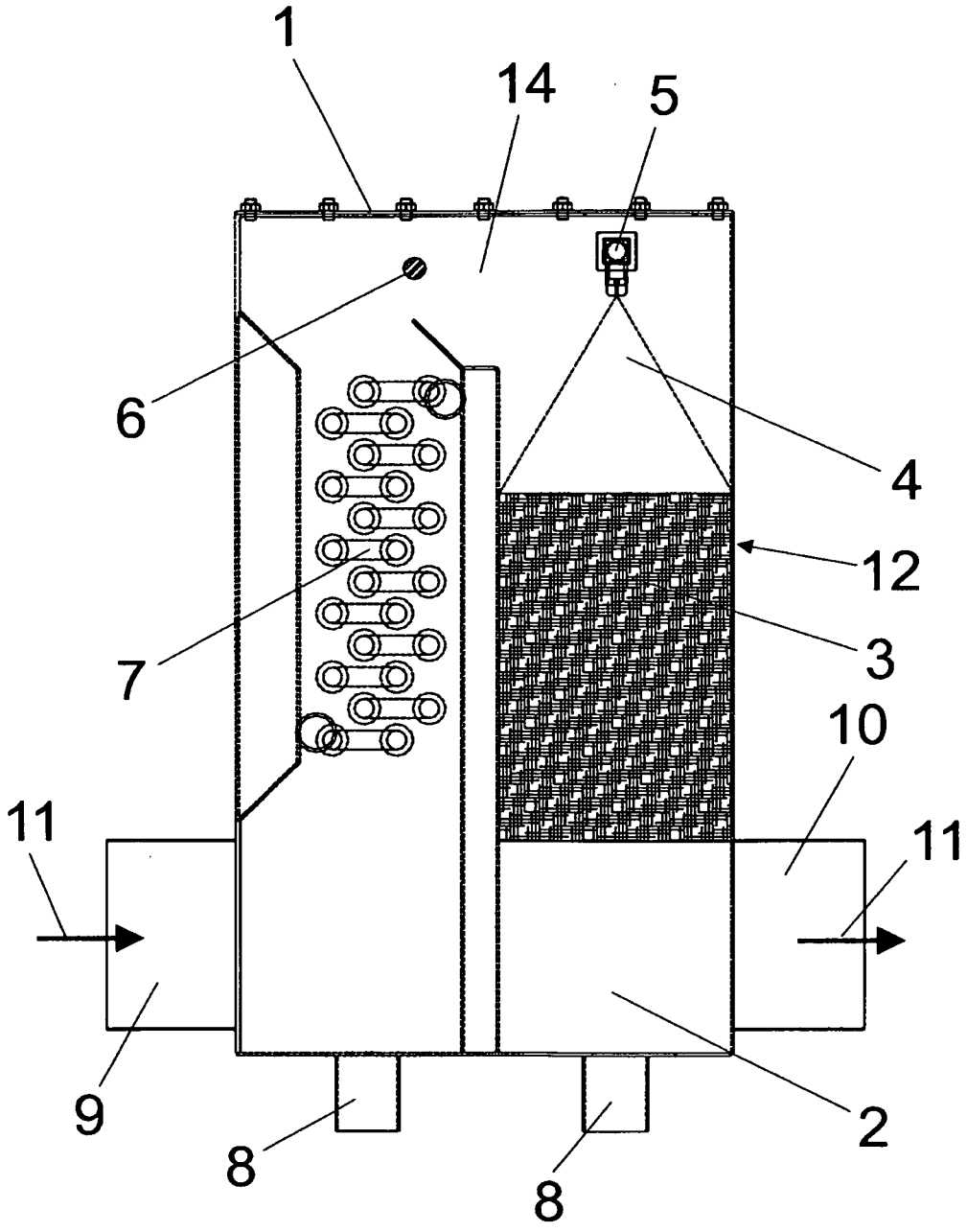
Figure 3:
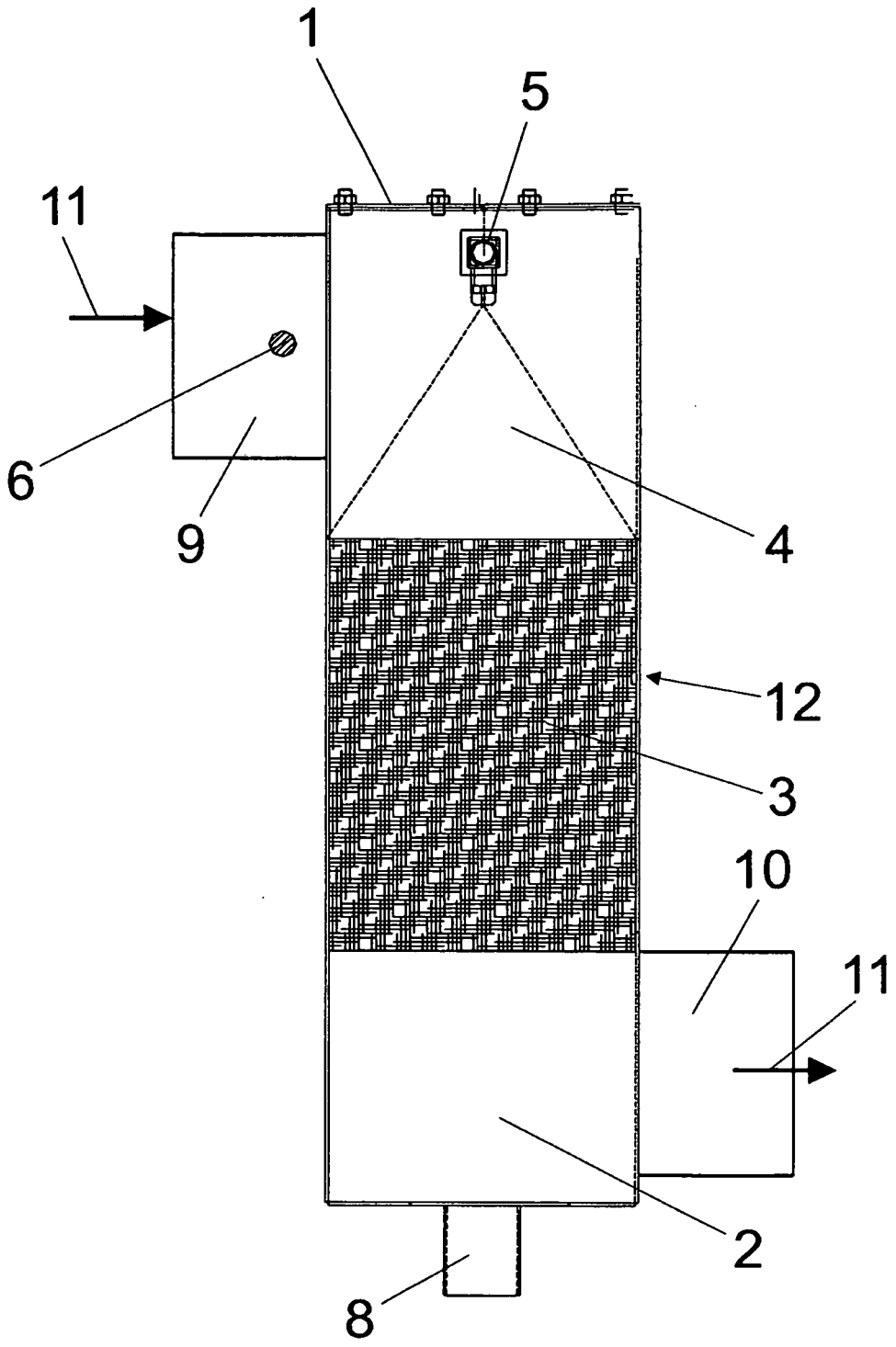
Figure 4:
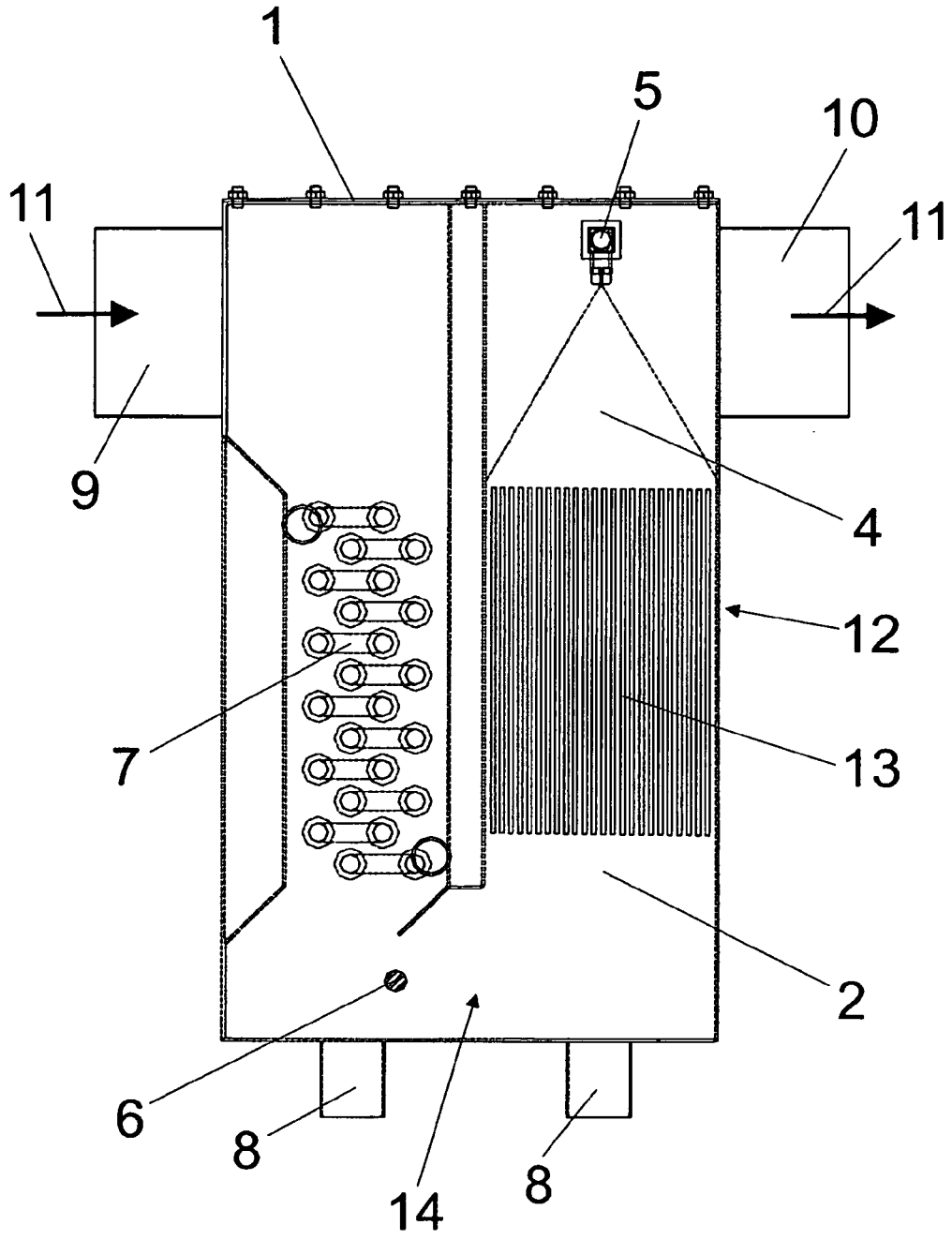

This shows:

FIG. 1—a first embodiment of an electro-filter according to the invention, having a preceding heat exchanger and a filling that consists of chips, in counter-current, FIG. 2—a variant of the electro-filter according to FIG. 1, with a counter-current flow direction, FIG. 3—a variant of the electro-filter according to FIG. 1, without a preceding heat exchanger, FIG. 4—a variant of the electro-filter according to FIG. 1, having a configuration of the filling that consists of plates.

In FIG. 1, the fundamental structure of the electro-filter 1 according to the invention is shown in a systematic representation, whereby FIGS. 2 to 4 represent corresponding variants of the electro-filter 1 according to FIG. 1. The same reference numbers refer to the same components, in this connection.

The electro-filter 1 according to FIG. 1 consists essentially of two chambers that are separated from one another and connected by way of an overflow channel 14, whereby a heat exchanger 7 is indicated in the front chamber, in the flow direction 11, with which exchanger corresponding amounts of heat can be coupled out of the exhaust gas stream. This heat exchanger 7 can be provided in the electro-filter 1 according to the invention, but does not have to, as can be seen from FIG. 3, for example.

After flow through the heat exchanger 7 in the flow direction 11, an electrode 6 is indicated in the region of the overflow channel 14, with which particles present in the exhaust gas stream are electrostatically charged, before they enter into the region of the precipitation device 12 in the precipitation chamber 2, and there are precipitated in the manner described below. In the electro-filter 1 according to FIG. 1, the stream of the exhaust gas is deflected multiple times after entering into the inlet 9, before the exhaust gas stream gets into the region of the precipitation device 12. Of course, more direct guidance of the exhaust gas stream, without these deflections, is also possible here, as can also be seen in FIG. 3.

In the region of the precipitation chamber 2, a precipitation device 12 composed of a filling 3 is disposed in such a manner that it fills the entire flow cross-section in the precipitation chamber 2, and the exhaust gas stream necessarily must pass through the precipitation device 12. In this connection, the filling of the precipitation device 12 can consist of a dense packing of chips or wool made of metallic materials or the like, for example, between which corresponding flow channels remain open and thus the exhaust gas stream can pass through the filling 3 as a whole. After the particles of the exhaust gas stream have been charged by the electrode 6, the particles have changed in such a manner that they can be deposited on the chips of the filling 3, in the case of grounding of the filling 3 or in the case of an opposite polarity of the filling 3, and are held in place there on the basis of electrical attraction forces. Thus, the filling 3 acts like a type of filter for the particles of the exhaust gas stream, on the basis of its electrical charge and the flow of the exhaust gas stream through it, and the particles are essentially captured within the filling 3 and retained there.

If this flow through the filling 3 were to continue over a certain period of time during operation of the electro-filter 1, the filling 3 would become clogged over time and would no longer be permeable. In order to avoid this effect, a nozzle 5 is disposed above the filling 3 of the precipitation device 12, in such a manner that it dispenses a cleaning fluid such as water, for example, in the form of a spray field 4, in the direction of the precipitation device 12, and this cleaning fluid flows through the filling 3 of the precipitation device 12 under the effect of gravity, and exits again at the lower end of the precipitation device 12. On the way through the filling 3, the cleaning fluid will wash the particles that are retained in the filling 3, off the filling 3, and thus will clean the filling 3 and flush the particles along with it by way of the channels between the chips, for example, of the filling 3. After exiting from the filling 3, the cleaning fluid flows into the lower region of the electro-filter 1 and can exit from the electro-filter 1 by way of the drains 8. Here, the cleaning fluid can be collected again, for example, and be passed back to the nozzle 5, after having been cleaned; also, it is possible, for example when water is used as the cleaning fluid, to pass the cleaning fluid to the waste water system, directly or after cleaning.

After passing through the precipitation device 12 and the spray field 4, in which a certain residual cleaning of the exhaust gas stream of any remaining particles will take place once again, the cleaned exhaust gas stream exits out of the outlet 10 once again, in the flow direction 11.

In FIG. 2, a modification of the electro-filter 1 of FIG. 1 is shown, in that the flow-through direction 11 of the exhaust gas stream through the electro-filter 1 runs in the opposite direction, and the exhaust gas stream passes through the precipitation device 12 in the direction of the spraying effect of the nozzle for the spraying field 4. Otherwise, the function of the electro-filter 1 as already described remains the same.

In FIG. 3, a modification of the electro-filter 1 of FIG. 1 is shown, in that the electro-filter 1 is configured without a heat exchanger 7 and therefore consists essentially only of the precipitation chamber 2 with the precipitation device 12 disposed in it. Here again, the function is analogous to the back part of the electro-filter 1 of FIG. 1, in the flow direction 11.

In FIG. 4, a modification of the electro-filter 1 of FIG. 1 can be seen, in that the filling 3 of the precipitation device 12 no longer consists of geometrically non-specific components such as chips, for example, but rather of a parallel arrangement of individual plates 13 that leave correspondingly narrow channels open between them, for passage of the gas stream of the exhaust gas. In this connection, the plates 13 are electrically charged or grounded, analogous to the chips of the filling 3, and interact with the particles of the exhaust gas in the manner already described. Because of the large surface area of the plates 13, correspondingly many particles can be deposited on the surfaces of the plates 13 when passing through the precipitation device 12 of FIG. 4, and they can be cleaned off again in the manner already described, by means of the spraying field 4.

REFERENCE NUMBER LIST

1—electro-filter
2—precipitation chamber
3—filling
4—spray field
5—nozzle
6—electrode
7—heat exchanger
8—drain
9—inlet
10—outlet
11—flow direction
12—precipitation device
13—plates
14—overflow channel

The invention claimed is:

1. Electro-filter for at least one of exhaust gas cleaning and heat recovery in which the electro-filter has a precipitation chamber through which the exhaust gas is passed, whereby a charging device for electrostatic charging of particles present in the exhaust gas is disposed in the region of the precipitation chamber or adjacent to the precipitation chamber, and a precipitation device that is electrostatically charged opposite to the charge of the particles, or is grounded, and has a large surface area in relation to a volume of the precipitation device, is disposed in the region of the precipitation chamber, to interact with the particles, through which device the particles electrostatically charged by the charging device flow, whereby a dispensing device for cleaning fluid sprays the region of the precipitation device, at least periodically, and the cleaning fluid cleans away the particles deposited on the surface of the precipitation device, wherein the precipitation device has a filling composed of electrostatically chargeable components in the form of an aggregate with a large surface area in relation to a volume of the filling, between which the exhaust gas can pass and give off the previously electrostatically charged particles of the exhaust gas.

2. Electro-filter according to claim 1, wherein the filling comprises an aggregate of individual components of the filling that are shaped in geometrically non-specific manner.

3. Electro-filter according to claim 2, wherein the individual components of the aggregate border on one another in such a state that an electrostatic charge or grounding applied externally to the precipitation device is distributed over the entire aggregate, and essentially all the individual components of the filling are electrostatically charged or grounded.

4. Electro-filter according to claim 3, wherein the filling has metallic chips or metallic wools.

5. Electro-filter according to claim 4, wherein the metallic chips comprise turnings.

6. Electro-filter for at least one of exhaust gas cleaning and heat recovery in which the electro-filter has a precipitation chamber through which the exhaust gas is passed, whereby a charging device for electrostatic charging of particles present in the exhaust gas is disposed in the region of the precipitation chamber or adjacent to the precipitation chamber, and a precipitation device that is electrostatically charged opposite to the charge of the particles, or is grounded, and has a large surface area in relation to a volume of the precipitation device, is disposed in the region of the precipitation chamber, to interact with the particles, through which device the particles electrostatically charged by the charging device flow, whereby a dispensing device for cleaning fluid sprays the region of the precipitation device, at least periodically, and the cleaning fluid cleans away the particles deposited on the surface of the precipitation device, wherein the precipitation device has a filling composed of electrostatically chargeable components in the form of a bulk material with a large surface area in relation to a volume of the filling, between which the exhaust gas Can pass and give off the previously electrostatically charged particles of the exhaust gas.

7. Electro-filter according to claim 6, wherein the electrostatically chargeable parts comprise electrostatically chargeable plastic bodies.

8. Electro-filter according to claim 1, wherein at least one of the filling and the precipitation device is renewable, independent of the rest of the electro-filter.

9. Electro-filter according to claim 8, wherein at least one of the filling and the precipitation device is introduced into the precipitation chamber in the form of a unit that is replaceable as a whole.

10. Electro-filter according to claim 9, wherein the unit is a cartridge.

11. Electro-filter according to claim 1, wherein the filling fills an entire passage cross-section of the precipitation chamber and wherein the entire exhaust gas flows through the filling.

12. Electro-filter according to claim 1, wherein the charging device is disposed ahead of the precipitation chamber, in a flow direction.

13. Electro-filter according to claim 1, wherein the charging device is disposed within the precipitation chamber ahead of the precipitation device, in a flow direction.

14. Electro-filter according to claim 1, wherein a number of nozzles is disposed in the precipitation chamber, in such a manner that the cleaning fluid is sprayed onto the precipitation device in the form of spray jets or in the manner of a mist.

15. Electro-filter according to claim 14, wherein the charging device is disposed within the precipitation chamber behind the nozzles, in a flow direction.

16. Electro-filter according to claim 1, wherein the cleaning fluid wets substantially all the individual components of the filling after being sprayed on and loosens and carries away particles of the exhaust gas deposited there.

17. Electro-filter according to claim 16, wherein the cleaning fluid, under the influence of gravity, wets substantially all the individual components of the filling after being sprayed on and loosens and carries away particles of the exhaust gas deposited there.

18. Electro-filter according to claim 1, wherein materials of the filling for cleaning of exhaust gases are configured in such a manner that the filling comprises a material that is electrochemically less noble than the rest of the precipitation device and therefore acts as a consumable electrode.

19. Electro-filter according to claim 1, wherein a heat exchanger is disposed ahead of, behind or ahead of and behind an entry into the precipitation chamber, in which exchanger at least one of the temperature of the exhaust gas is lowered and a part of the amount of heat contained in the exhaust gas is recovered.

20. Electro-filter according to claim 1, wherein the precipitation device is structured so that it can be retrofitted for existing exhaust gas systems.

21. Electro-filter according to claim 1, wherein the electro-filter is for exhaust gas cleaning for the exhaust gases of biomass firings.

22. Method for exhaust gas cleaning and heat recovery in which an electro-filter has a precipitation chamber through which the exhaust gas is passed, whereby a charging device for electrostatic charging of particles present in the exhaust gas is disposed in the region of the precipitation chamber or adjacent to the precipitation chamber, the particles electrostatically charged by the charging device are passed through a region of the precipitation chamber in which a precipitation device that is electrostatically charged opposite to the charge of the particles, or is grounded, is disposed, whereby the region of the precipitation device is sprayed, at least periodically, by sprayed-in cleaning fluid, and the particles deposited on the surface of the precipitation device are cleaned off, wherein the exhaust gas with the electrostatically charged particles is guided through the precipitation device with a filling composed of electrostatically chargeable components in the form of an aggregate with a large surface area in relation to a volume of the filling, or through an arrangement of at least one of metallic and electrostatically chargeable devices with geometrically determined shape and a plurality of channels between these devices, between which the exhaust gas passes and gives off the previously electrostatically charged particles of the exhaust gas.

23. Method according to claim 22, wherein the cleaning fluid is collected after the cleaning fluid passes through the precipitation device.

24. Method according to claim 23, wherein the cleaning fluid is introduced into the waste water network.

25. Method according to claim 22, wherein the cleaning fluid is collected and cleaned after passing through the precipitation device.

26. Method according to claim 25, wherein the cleaning fluid is re-used.

27. Method according to claim 22, wherein cleaning of the filling takes place automatically, in time-controlled manner.

28. Method according to claim 22, wherein water is used as the cleaning fluid.

29. Method according to claim 22, wherein spraying the cleaning fluid in takes place in a flow direction of the exhaust gas through the filling.

30. Method according to claim 22, wherein spraying the cleaning fluid in takes place counter to a flow direction of the exhaust gas through the filling.

31. Method according to claim 22, wherein spraying the cleaning fluid in takes place in a cross-current or substantially transverse to a flow direction of the exhaust gas through the filling.

32. Method according to claim 22, wherein the exhaust gas passes through a heat exchanger, before, after or before and after entry into the precipitation chamber, in which exchanger at least one of the exhaust gas temperature is lowered and a part of the heat amount contained in the exhaust gas is recovered.

33. Method according to claim 22, wherein the method is for exhaust gas cleaning for the exhaust gases of biomass firings.

34. Electro-filter for at least one of exhaust gas cleaning and heat recovery in which the electro-filter has a precipitation chamber through which the exhaust gas is passed, whereby a charging device for electrostatic charging of particles present in the exhaust gas is disposed in the region of the precipitation chamber or adjacent to the precipitation chamber, and a precipitation device that is electrostatically charged opposite to the charge of the particles, or is grounded, and has a large surface area in relation to a volume of the precipitation chamber, to interact with the particles, through which device the particles electrostatically charged by the charging device flow, whereby a dispensing device for cleaning fluid sprays the region of the precipitation device, at least periodically, and the cleaning fluid cleans away the particles deposited on the surface of the precipitation device, wherein the precipitation device has a filling in a form of an aggregate, has an arrangement of at least one of metallic and electrostatically chargeable devices with geometrically determined shape, between which devices a plurality of channels for passing the exhaust gas are formed and in which the electrostatically charged particles of the exhaust gas can be deposited on the opposite charged surfaces of these devices.

35. Electro-filter according to claim 34, wherein the electro-filter is for exhaust gas cleaning for the exhaust gases of biomass firings.

* * * * *